US005852835A

United States Patent [19]

Steinhardt et al.

[11] Patent Number: 5,852,835

[45] **Date of Patent: *Dec. 29, 1998**

[54] PLUMBING NOZZLE

[75] Inventors: Michael D. Steinhardt, Kiel; John A. Fiumefreddo, Plymouth; Michael J. Kurth, Fond du Lac, all of Wis.

[73] Assignee: Kohler Co., Kohler, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 572,583

[22] Filed: Dec. 14, 1995

Related U.S. Application Data

[63] Continuation of Ser. No. 238,998, May 6, 1994, abandoned.

[51] Int. Cl.[6] ..... A47K 3/22

[52] U.S. Cl. ..... 4/541.6; 239/456

[58] Field of Search ..... 4/541.1, 541.3, 4/541.4, 541.6, 567, 568, 570, 601, 605, 615; 239/456, 459

[56] References Cited

U.S. PATENT DOCUMENTS

| | | | |
|---|---|---|---|
| 515,491 | 2/1894 | Hanford | 239/459 X |
| 571,940 | 11/1896 | Binford | 239/456 |
| 801,210 | 10/1905 | Burnett | 239/456 |
| 1,143,293 | 6/1915 | Luehrs | 239/456 X |
| 1,476,471 | 12/1923 | Schlesinger | 4/624 |
| 2,105,154 | 1/1938 | Maxon | 299/107 |
| 2,270,595 | 1/1942 | Lewis | 239/456 |
| 2,519,737 | 8/1950 | Brassington et al. | 239/456 |
| 2,716,915 | 9/1955 | Biber | 82/152 |
| 2,806,741 | 9/1957 | Fishelson et al. | 239/456 |
| 2,991,016 | 7/1961 | Allenbaugh, Jr. et al. | 239/459 |
| 3,216,653 | 11/1965 | LeNabour | 417/196 |
| 3,462,085 | 8/1969 | Nugarus | 239/515 |
| 4,295,608 | 10/1981 | White | 239/14.2 |
| 4,550,454 | 11/1985 | Yui | 4/420.4 |
| 4,653,693 | 3/1987 | Steingass | 239/456 |
| 5,215,260 | 6/1993 | Robbins | 239/590.5 |

FOREIGN PATENT DOCUMENTS

| | | | |
|---|---|---|---|
| 0980597 | 5/1951 | France | 239/456 |
| 2293252 | 7/1976 | France . | |
| 2552648 | 4/1985 | France | 4/615 |
| 3601064 | 7/1987 | Germany | 4/541.1 |
| 982598 | 2/1965 | United Kingdom . | |

*Primary Examiner*—Robert M. Fetsuga
*Attorney, Agent, or Firm*—Quarles & Brady

[57] ABSTRACT

A plumbing nozzle is disclosed that discharges a hollow cylinder of water. In a preferred form, the cylinder flows along a horizontal axis as the water is discharged from the nozzle. The nozzle has a core member with an angled wall surface which directs water against an inner wall surface of the nozzle. The inner wall encloses upon itself and has an outwardly diverging wall surface. The nozzle is particularly useful in conjunction with a bathing fixture with recirculating water.

13 Claims, 3 Drawing Sheets

FIG. 1
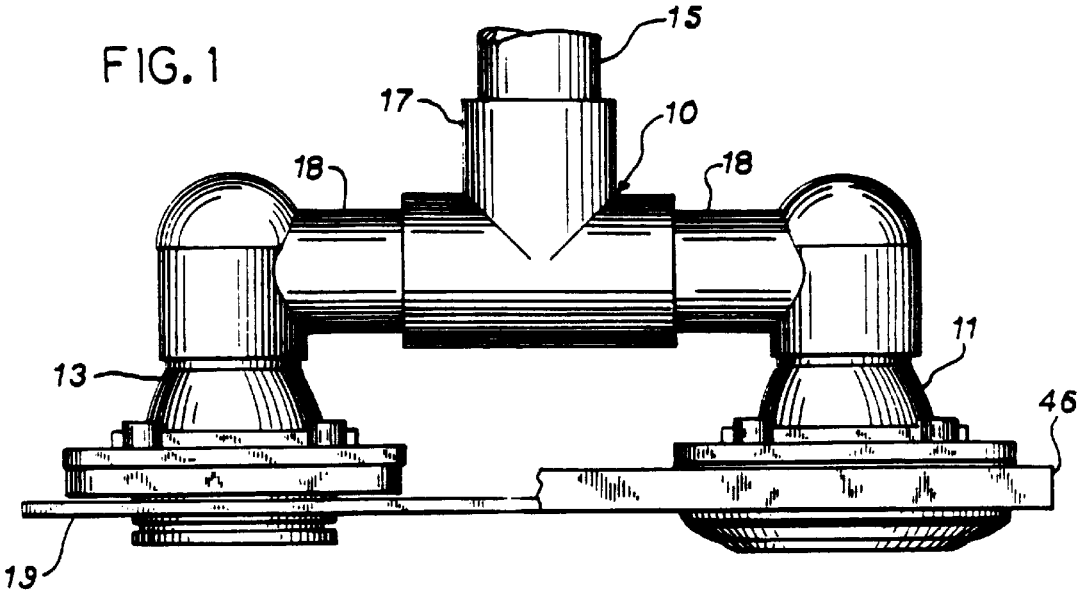
FIG. 2
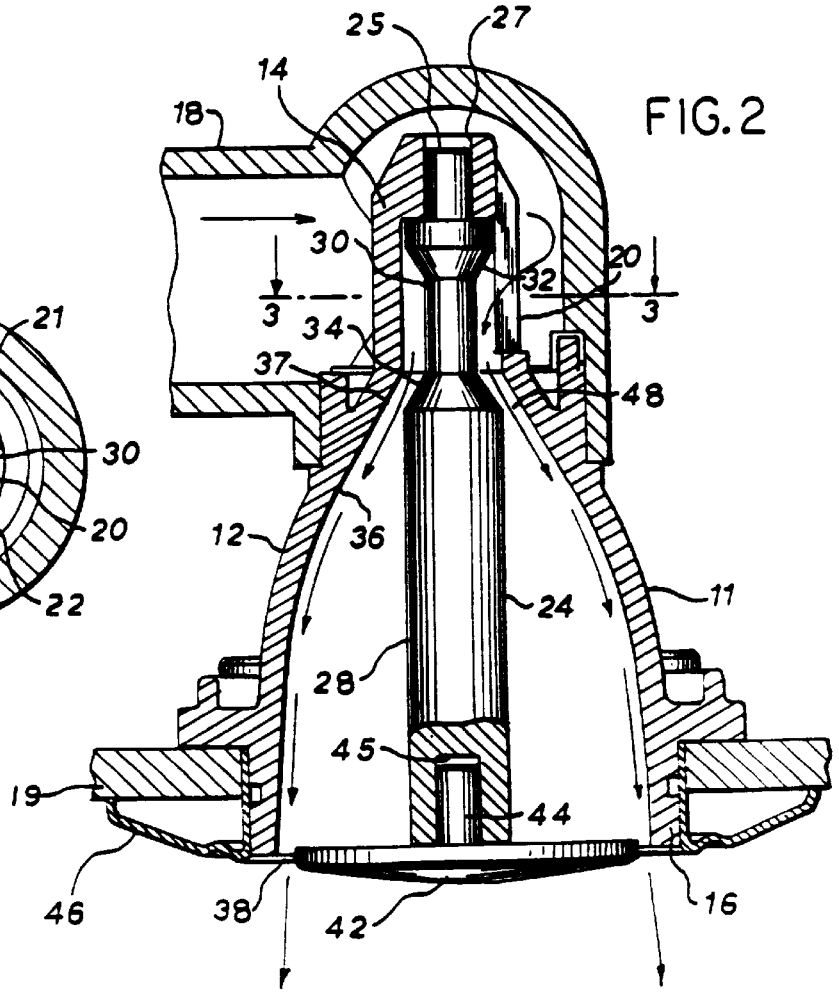
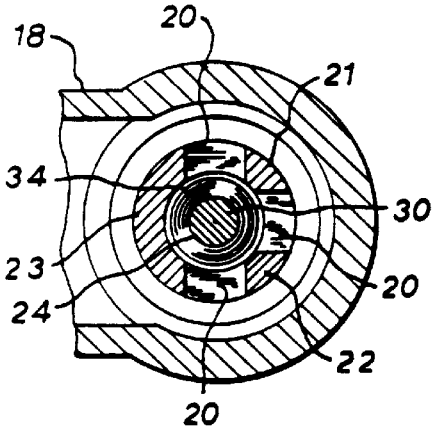
FIG. 3

FIG. 6
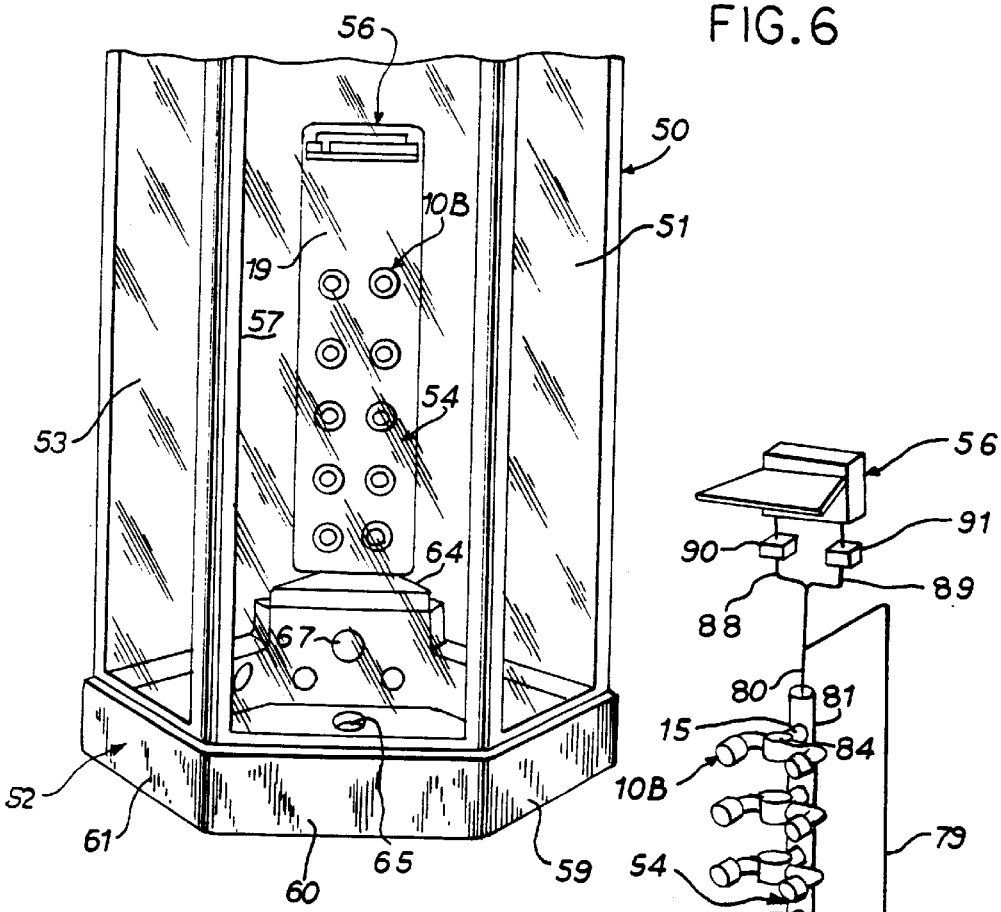
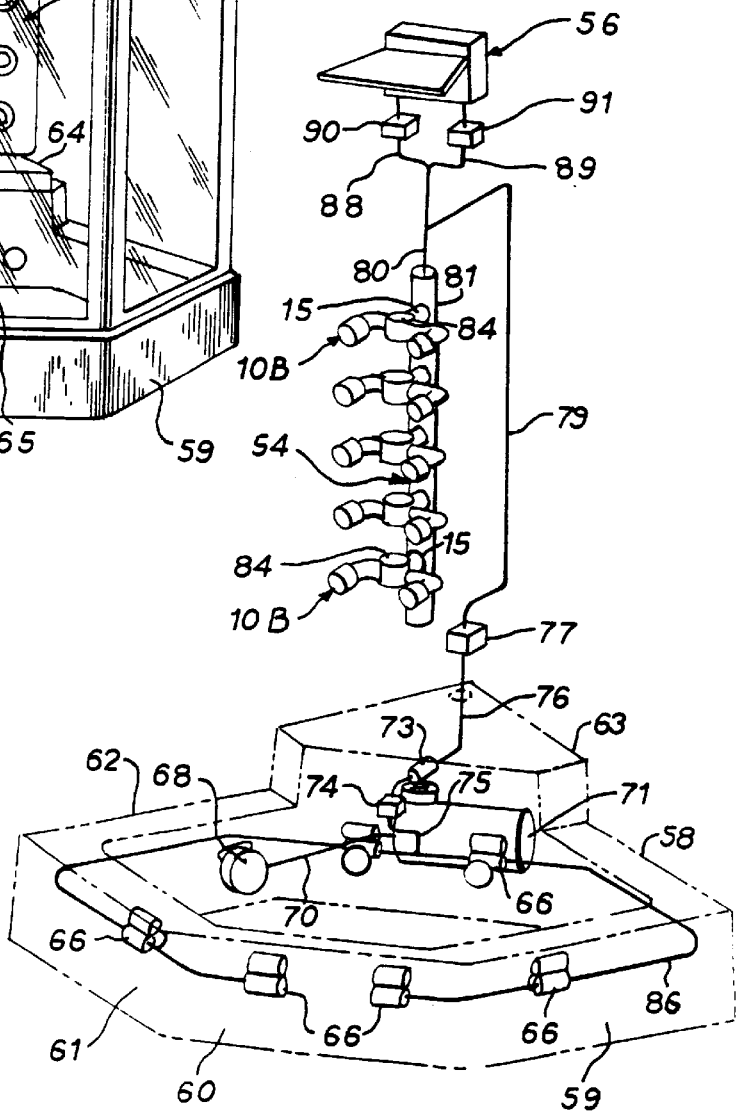
FIG. 7

PLUMBING NOZZLE

This is a continuation of application Ser. No. 08/238,998 filed May 6, 1994, abandoned.

BACKGROUND OF THE INVENTION

A. Field of the Invention

This invention relates to a type of nozzle that will discharge a continuous sheet of fluid wherein the sheet encloses upon itself and creates a cavity within the sheet.

B. Description of the Art

In recent years increasing efforts have been made to cause water to flow from faucets or nozzles in tubular configurations. This is primarily done for aesthetic reasons, but also assists in water conservation. For example, it is known in the art to cause water to flow outward in the form of a vertical tube using a donut shaped nozzle. This is taught in U.S. Pat. No. 5,215,260.

Also, many spouts or shower heads spray water through holes or slits to create individual jets of water. The holes or slits in such spouts have in some nozzles been configured in an array so that the individual jets of water extend around the perimeter of a circle. See e.g. U.S. Pat. No. 1,476,471.

One problem with nozzles of this type is that when the outlet is positioned to permit horizontal exit of the water, the wall of the cylindrical cavity defined by the water tends to come together within a short distance after the water flows from the spout. Another problem is that in such a position of the outlet the water wall tends to break apart or become non-uniform as the water flows from the nozzle.

Increasing the pressure of the water from the nozzle flowing in a continuous sheet from a nozzle helps maintain the integrity of the sheet as the water flows horizontally therefrom, but has adverse water conservation and skin impact attributes. It is desirable to maintain sheet integrity in a horizontal exit nozzle without having to substantially increase water pressure.

Yet another problem not addressed by the prior art is plugging of such nozzles in circumstances in which the water may be contaminated with particulates (e.g. bathing water is being recirculated to the nozzle).

Thus, it can be seen that there is a need for an improved nozzle of the above type.

SUMMARY OF THE INVENTION

In one aspect, the present invention provides a plumbing nozzle for discharging a continuous sheet of liquid, wherein the sheet has a closed perimeter in a cross sectional plane and a cavity within the sheet. The nozzle includes a nozzle body having an inner wall that encloses upon itself with the inner wall presenting an outwardly diverging wall surface.

The nozzle body also has an inlet portion and an outlet portion. A core member or stem is positioned within the inner wall and has thereon an angled outwardly directed surface which is constructed and arranged to direct a flow of liquid against the inner diverging wall surface of the nozzle body. There are baffle means operatively associated with the inlet portion of the nozzle body to distribute liquid around the core member in the nozzle body and inlet means for carrying liquid from a source to the inlet portion.

In another aspect, the core member is axially positioned with respect to the inner wall and has a reduced width area adjacent the inlet portion.

In a preferred embodiment, the angled surface of the core member forms a portion of the reduced width area, and the angle of the angled surface is essentially 35° as measured from an outer surface of the core member.

In another aspect, the angled surface of the core member and the inner wall of the nozzle body are constructed and arranged adjacent to each other to provide an orifice which is unobstructed.

In another preferred embodiment, the inner wall of the nozzle body terminates in a sharp edge at the outlet portion.

In still another preferred embodiment, the nozzle is connected to a shower fixture wherein water is recirculated from a bathing basin to the nozzle.

BRIEF DESCRIPTION OF THE DRAWINGS

FIG. 1 is a top plan view of a plumbing nozzle assembly illustrating two of the nozzles of this invention joined together;

FIG. 2 is an enlarged horizontal sectional view of one of the nozzles shown in FIG. 1;

FIG. 3 is a sectional view taken along line 3—3 of FIG. 2;

FIG. 6 is a front perspective view showing the plumbing nozzle assembly in a bathing fixture; and FIG. 7 is a diagrammatic view showing water recirculation pathways.

DESCRIPTION OF THE PREFERRED EMBODIMENTS

Figure 4:
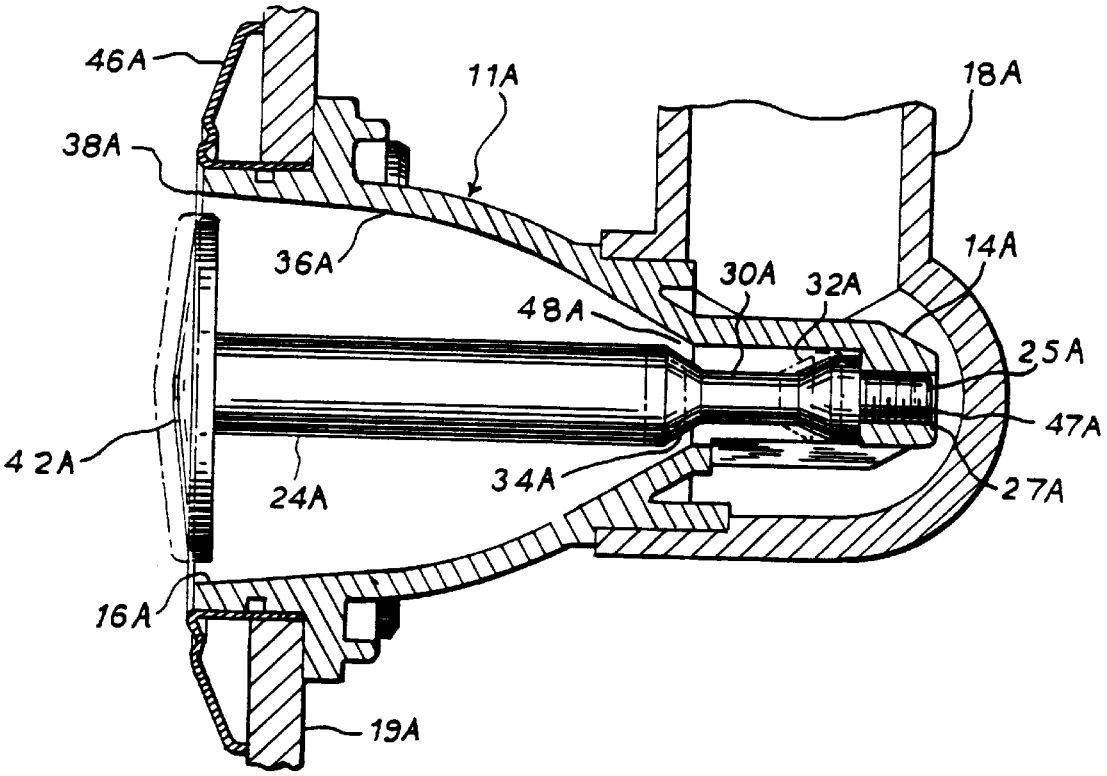
FIG. 4 is a view similar to FIG. 2 showing an alternative embodiment.

A plumbing nozzle assembly, generally 10, is shown in FIG. 1 having two plumbing nozzles 11 and 13 which are connected to a water inlet line 15 by the "T" connector 17. As illustrated in FIGS. 2 and 3, the two jet plumbing nozzles 11 and 13 each have a body member 12 with a water inlet section 14 and an outlet section 16, the inlet section 14 being connected to the water supply elbow 18. Water passes through the three passageways 20 with the walls 21, 22 and 23 of the inlet section 14 acting as baffles. A core member 24 is axially positioned in the body member 12 and is retained therein by a reduced diameter portion 25 seated in opening 27 of the inlet section 14 of the body member 12.

There is a reduced width area 30 on the core member 24 formed by the opposing and spaced apart angled wall surfaces 32 and 34 positioned adjacent the inlet section 14. In a preferred manner, the angle of angled surface 34 is 35° as measured from the outer surface 28 of the core member 24 and is provided by a conical portion of the core member. Water flows into this reduced area 30 and is directed by angled wall surface 34 toward and against inner wall 36. As shown by the directional arrows, water flows along the diverging and conical wall 36 which increases in diameter and encloses upon itself and then out of the nozzle outlet section 16. There it passes over the sharp edge 38 at the outermost portion of the body member 12.

As the water flows from the body member 12, it forms an essentially circular or conical sheet of water with a closed perimeter in a cross sectional plane and a cavity within the sheet. The previously described sheet of water flows along a horizontal axis from the discharge end or outlet section 16.

A trim cover 42 is attached to the core member 24 by the projection 44 seated in the compartment 45. A trim ring 46 is suitably connected to the body member 12 for placement against a panel 19 of jet nozzle assembly, generally 54, as will be later explained in conjunction with FIG. 6.

Figure 5:
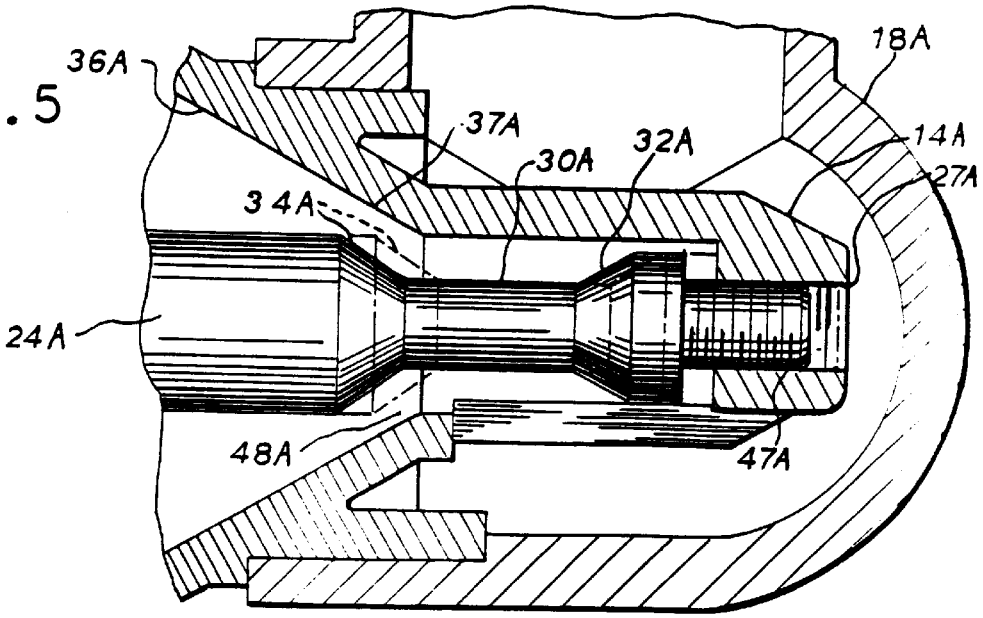
FIG. 5 is an enlarged partial view in section of the embodiment shown in FIG. 4.

FIGS. 4 and 5 show an alternative embodiment of nozzle 11 where the same numbers indicate the same or similar elements except with an "A" suffix. Nozzle 11A differs from nozzle 11 in having external threads 47A on the reduced diameter portion 25A of the core member 24A, as well as corresponding internal threads in opening 27A. This allows for adjustment of the gap 48A between angled surface 34A and the adjacent surface 37A of inner wall 36A. This distance will be determined by the water pressure and the flow rate which in some instances can reach flow rates of 8 GPM or 80 GPM for all ten nozzles. These rates can be higher if desired. The threaded adjustment is an optional feature and in most instances will not be used. Instead this distance will be determined at the manufacturing facility and preset without the use of threads.

Referring particularly to FIGS. 6 and 7, a plurality of plumbing nozzle assemblies 10B are shown in conjunction with a shower fixture, generally 50. Nozzle assemblies 10B are similar to assembly 10 in each including nozzles 11 and 13. In place of the "T" connector 17, there is a valve 84 which also acts as a connector to inlet line 15.

Shower fixture 50 includes a bathing basin generally 52, a jet nozzle tower, generally 54, and a waterfall spout generally 56. The basin 52 is essentially disclosed in U.S. Pat. No. 5,289,599 and is commonly assigned. Its teachings are herein incorporated by reference.

The basin 52 is of the foot bath whirlpool type, and includes side walls 58, 59, 60, 61, and 62. There is also provided a seat 64 and a drain 65. An enclosure is effected by the side panels 53 and 51 and a door panel 57 (and the bathroom side walls). There are whirlpool jet outlets 66 in the basin as well as an overflow drain 67. As best seen in FIG. 7, an inlet 68 to the recirculation system is connected by the line 70 to the pump 71, which feeds bathing water to the jets 66 by means of the "T" connector 73, valve 74 and outlet line 75. A variable flow valve 77 controls the flow of water to body spray nozzle tower 54 by means of line 79, as well as the waterfall spout 56. Water will be initially introduced to the basin 52 such as by a standard bath spout (not shown).

The nozzle tower 54 receives water from line 80 and manifold 81 which is connected to a series of nozzle assemblies 10B by inlet lines 15. The five sets of the nozzle assemblies 10B are each individually controlled by valves 84 so that water can be sprayed from the nozzle assemblies 10B at different heights if desired.

Water is recirculated to the nozzle tower 54 as well as the water fall spout 56 and the whirlpool jet outlets 66. These can either be alternative flow paths, or if desired, simultaneous flows. As indicated previously, the flow of water can be controlled separately in the jet nozzle tower 54 by the valves 84. Water would be supplied from the basin 52 by inlet 68, inlet line 70, pump 71, connector 73, outlet line 76, valve 77, and lines 79 and 80, as well as manifold 81 feeding inlets 15.

Water is also recirculated to the waterfall spout 56 from line 80, to branch lines 88 and 89 and valves 90 and 91. It is recirculated to the jet outlets 66 by the valve 74, outlet line 75 and line 86.

An important feature of the invention is the directing of the water in the nozzles 11 and 11A over the angled wall surfaces 34 and 34A and against the respective inner walls 36 and 36A which enclose upon themselves and provide an outwardly diverging wall surface. This effects the formation of a circular pattern of a sheet of water, and in a preferred manner, along a horizontal axis. The wide gap 48 and 48A between the angled wall surfaces 34, 34A and the adjacent wall surfaces 37, 37A of inner walls 36, 36A affords a control orifice which is not easily plugged. This is an important consideration where recirculating water is employed.

Another important feature is the sharp edges 38, 38A at the outlets section 16, 16A of the body members 12, 12A. This provides a straight and smooth outer surface to the sheet of water. If a sharp edge is not provided, and for example is radiused or curved, this result cannot be effected.

Thus, the invention provides an improved nozzle. While the preferred embodiments have been described above, it should be readily apparent to those skilled in the art that a number of modifications and changes may be made without departing from the spirit and scope of the invention. For instance, the present invention also contemplates flowing the sheet of fluid in other geometric configurations which are not the perimeter of a circle in a vertical plane such as but not limited to oval, triangular or rectangular patterns are contemplated, as well as conical configurations. These other geometric configurations would be effected by designing the angled surface 34 and wall 36 with corresponding geometric configurations. In the instance of these configurations having corners, it may be necessary to partially deflect flow away from the corners of the angled surface.

Further, the nozzle can be utilized with pressurized water sources which are not recirculated and can direct the sheet of water along a vertical axis as well as a horizontal one. Also, a valve can be placed in inlet line 15 instead of in a "T" connector. All such modifications and other modifications within the spirit of the invention are meant to be in the scope of the invention.

We claim:

1. A plumbing nozzle for discharging a continuous sheet of liquid, wherein the sheet defines a closed perimeter in a cross sectional plane and a cavity within the sheet, the nozzle comprising:

a nozzle body having an inner wall that encloses upon itself and defining a wall surface that diverges radially outward in a curved manner, the nozzle body having a radial inlet portion, and an outlet portion downstream thereof providing an unobstructed flow path along the inner wall;

a core member positioned within the inner wall and having thereon an angled outwardly directed surface, the angled surface being constructed and arranged to direct a flow of liquid against the adjacent inner diverging wall surface of the nozzle body, the inner wall being essentially conical in shape at the inlet portion and being essentially parallel to a central longitudinal axis of the nozzle body at the outlet portion, the sheet of liquid also being conical in the nozzle body but being circular immediately after exiting the nozzle body adjacent an end of the inner wall;

baffle means operatively associated with the radial inlet portion of the nozzle body to distribute liquid around the core member in the nozzle body; and inlet means for carrying liquid from a source to the inlet portion.

2. The nozzle of claim 1, wherein the core member is axially positioned with respect to the inner wall.

3. The nozzle of claim 2, wherein the core member has a reduced width area adjacent the inlet portion.

4. The nozzle of claim 3, wherein the angled surface of the core member forms a portion of the reduced width area.

5. The nozzle of claim 1, wherein the angle of the angled surface is essentially 35° as measured from an outer surface of the core member.

6. The nozzle of claim 1, wherein the core member is adjustably positioned in the nozzle body.

7. The nozzle of claim 1, wherein the angled surface of the core member and the inner wall of the nozzle body are constructed and arranged adjacent to each other to provide an orifice which is unobstructed.

8. The nozzle of claim 1, wherein the core member extends from the inlet portion to the outlet portion and a cover member is connected thereto at the outlet portion.

9. The nozzle of claim 1, wherein the inner wall of the nozzle body terminates in a sharp edge at the outlet portion.

10. The nozzle of claim 1, wherein the angled surface is provided by a conical portion of the core member.

11. A plumbing nozzle for use in a shower enclosure and for discharging a continuous sheet of water, wherein the sheet defines a closed perimeter in a cross sectional vertical plane and a cavity within the sheet, the nozzle comprising:

a nozzle body adapted to be connectable to the shower enclosure, the nozzle body having an inner wall that encloses upon itself and defining a wall surface that diverges radially outward in a curved manner, the nozzle body having a radial inlet portion and an outlet portion downstream thereof providing an unobstructed flow path along the inner wall;

a core member positioned within the inner wall and having thereon an angled outwardly directed surface, the angled surface being constructed and arranged to direct a flow of water against the adjacent diverging wall surface of the nozzle body, the inner wall being essentially conical in shape at the inlet portion and being essentially parallel to a central longitudinal axis of the nozzle body at the outlet portion, the sheet of liquid also being conical in the nozzle body but being circular immediately after exiting the nozzle body adjacent an end of the inner wall; and baffle means operatively associated with the radial inlet portion of the nozzle body to permit distribution of water around the core member.

12. A nozzle assembly of claim 11, wherein the shower enclosure includes means to recirculate water from a bathing basin to the nozzle body.

13. The nozzle of claim 1, wherein the radial inlet portion is defined by a plurality of radially disposed ports.

* * * * *

UNITED STATES PATENT AND TRADEMARK OFFICE

CERTIFICATE OF CORRECTION

PATENT NO. : 5,852,835

DATED : December 29, 1998

INVENTOR(S) : Michael D. Steinhardt et al.

It is certified that error appears in the above-identified patent and that said Letters Patent is hereby corrected as shown below:

Column 6

Claim 12, line 1 - before "nozzle" "A" should be --The--.

Signed and Sealed this

Twenty-second Day of June, 1999

*Attest:*

Q. TODD DICKINSON

*Attesting Officer*

*Acting Commissioner of Patents and Trademarks*